US007517070B2

(12) United States Patent
Kitagawa et al.

(10) Patent No.: US 7,517,070 B2
(45) Date of Patent: Apr. 14, 2009

(54) INK TANK, RECORDING HEAD AND PACKAGE INCLUDING THE INK TANK AND THE RECORDING HEAD

(75) Inventors: Takatoshi Kitagawa, Kawasaki (JP); Kenjiro Watanabe, Ohta-ku (JP); Nobuyuki Hatasa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 11/295,376

(22) Filed: Dec. 6, 2005

(65) Prior Publication Data

US 2006/0125889 A1 Jun. 15, 2006

(30) Foreign Application Priority Data

Dec. 9, 2004 (JP) ..... 2004-357306

(51) Int. Cl.
*B41J 2/175* (2006.01)

(52) U.S. Cl. ..... 347/86

(58) Field of Classification Search ..... 347/86, 347/87; 206/96, 484.1; 220/361, 373
See application file for complete search history.

(56) References Cited

U.S. PATENT DOCUMENTS 4,942,408 A * 7/1990 Braun ..... 347/63
5,131,539 A * 7/1992 Karita et al. ..... 206/462
5,182,581 A * 1/1993 Kashimura et al. ..... 347/87
5,278,584 A 1/1994 Keefe
6,409,325 B1 * 6/2002 Matsumoto et al. ..... 347/87
6,706,349 B2 3/2004 Eida
6,761,825 B2 * 7/2004 Kirk ..... 210/660
7,185,786 B2 * 3/2007 Krause et al. ..... 222/1

FOREIGN PATENT DOCUMENTS

JP 11-170554 A 6/1999
JP 11-348308 A 12/1999
JP 2001-348053 A 12/2001

* cited by examiner

*Primary Examiner*—Anh T. N. Vo
(74) *Attorney, Agent, or Firm*—Canon USA, Inc. IP Division

(57) ABSTRACT

A package is formed including an ink tank in a bag. A cap is attached to an ink supply port of the ink tank. In the cap including an adsorption material made of zeolite, the adsorption material is arranged in a position in the cap where the adsorption material does not interfere with the ink tank when the cap is attached to the ink tank. By this arrangement, it is possible to adsorb ammonia gas issuing from the ink tank and hold down the amount of ammonia gas that reacts with electrodes of the substrate on the ink tank. Zeolite adsorbs and releases ammonia gas and does not adsorb ammonia gas limitlessly; therefore, it is possible to prevent notable changes in the composition of components of the ink stored.

9 Claims, 12 Drawing Sheets

INK TANK, RECORDING HEAD AND PACKAGE INCLUDING THE INK TANK AND THE RECORDING HEAD

BACKGROUND OF THE INVENTION

1. Field of the Invention

The present invention relates to an ink tank, a recording head, and a package including the ink tank and the recording head in a distribution form.

2. Description of the Related Art

As a well-known type of recording apparatus for recording on recording media, such as paper, cloth, plastic sheet, or sheet for OHP (hereafter collectively referred to simply as recording paper), there is the ink jet type recording apparatus each provided with a recording head.

The ink jet type recording apparatus has been commercialized and is widely used as output units of information processing equipment, such as printers at the output terminal of copying machines, facsimiles, electronic typewriters, word processors, and work stations. Moreover, the ink jet recording apparatus is available on the market as hand-held or portable printers for personal computers, host computers, optical disk devices, video devices, etc.

There have been proposed various kinds of ink discharge methods in the ink jet recording head, among which the recording head that discharges the ink by a thermal energy conversion element is advantageous in that discharge nozzles can be arranged with high density and the size of the recording head itself can be reduced easily. Additional advantages of this recording head are that it is possible to make full use of the merits of integrated circuit (IC) technology and microfabrication technology in the semiconductor sector, and that the ease of high-density packaging reduces production cost.

In consumer printers, the ink tank for storing ink to be supplied to the recording head, is replaced with a new ink tank when it becomes empty. The ink tank is structured such that the user can easily change ink tanks. Even with an ink cartridge which is a unified body of a recording head and an ink tank, the ink tank is replaced with a new one when the ink is consumed.

To take an example of a detachable ink tank, one which is disclosed in Japanese Patent Application Laid-Open No. 11-348308 (corresponding to U.S. Pat. No. 5,278,584) is known. The ink tank described in Japanese Patent Application Laid-Open No. 11-348308 includes a data storage medium for storing information about ink stored in it. More specifically, the substrate attached to the ink tank has an electric circuit including memory elements and electric contacts thereon, and various items of information about stored ink are written on the memory elements. Therefore, the recording apparatus with the ink tank mounted on it reads stored information and performs recording based on read information to obtain proper record output.

Incidentally, an ink tank detachable from a device such as mentioned above or a single unified cartridge of a recording head and ink tanks, after being shipped from the manufacturer and following the distribution process until they are used, are left in distribution-purpose packages. As for the form of package, ink tanks or cartridges are mostly contained in tightly-sealed packages. Depending on the physical distribution environment, the solvent components may evaporate from the ink of ink tanks or cartridges packed in packages.

Japanese Patent Application Laid-Open Nos. 11-170554 (corresponding to U.S. Pat. No. 6,706,349) and 2001-348053 disclose that an amount of ink evaporation can be minimized by enhancing the sealing performance of packages. According to Japanese Patent Application Laid-Open Nos. 11-170554 and 2001-348053, if the amount of evaporation of ink components from the ink tank can be reduced, changes in ink characteristics (change in ink components, for example) can be prevented. If the sealing performance is improved, even though the ink leaks from the ink tank, the leaked ink can be prevented from spilling out. If spillage of ink can be prevented, it is possible to prevent the leaked ink from staining the user or the equipment.

Though a continuous evaporation of ink components can be prevented by a tightly-sealed structure of a package, the ink components are saturated in the package. On the other hand, with regard to ink tanks without electric circuits, such as memory elements, no problem is observed. However, with ink tanks fitted with an electric circuit or with a recording head which naturally includes electric circuits, the ink components which are saturated in the packages can damage the electric circuits when they are contained in packages.

For example, there is ammonia among the components that evaporates from the ink, and ammonia reacts with materials, such as wires of the electric circuits of the ink tanks or copper used in electric contacts. If the package is tightly-sealed, because ammonia gas is not discharged out of the package, the ammonia gas reacts with many of the wires and electric contacts. As a result, corrosion can develop at the wires and the electric contacts used on the substrate attached to the ink tank or the recording head.

As a countermeasure against corrosion, it is considered to remove ammonia gas liberated in the tightly-sealed structure of a package by some means. However, depending on the amount of ammonia to be removed, there is a possibility that the components of the ink contained in the ink tank may change. If the ink components should change, it is feared that recording results, such as printing quality, are affected.

SUMMARY OF THE INVENTION

The present invention is directed to an ink tank, a recording head, and a package including the ink tank and the recording head which reduces the amount of reaction of ammonia gas issuing from the ink stored in the ink tank with a substrate attached to the ink tank. The invention also minimizes a change in the characteristic of the ink in the ink tank.

In one aspect of the present invention, an ink tank for holding ink, which is handled contained in a bag-like packet, includes a supply port adapted to supply the ink to the outside; a substrate including a contact facilitating electrical connection; a protective member configured to protect the supply port; and an ammonia adsorption material disposed in the protective member.

In another aspect of the present invention, an ink tank for holding ink, which is handled contained in a bag-like packet, includes a supply port adapted to supply the ink to the outside; a substrate including a contact facilitating electrical connection; a component member; and an ammonia adsorption material disposed in the component member.

In another aspect of the present invention, a recording head for discharging ink, which is handled contained in a bag-like packet, includes a discharge port adapted to discharge ink; a substrate including a contact facilitating electrical connection; a protective member configured to protect the discharge port; and an ammonia adsorption material disposed in the protective member.

In another aspect of the present invention, a recording head for discharging ink, which is handled contained in a bag-like packet, includes a discharge port adapted to discharge ink; a substrate including a contact facilitating electrical connection; a component member; and an ammonia adsorption material is disposed in the component member.

In another aspect of the present invention, a package includes a bag-like packet and at least one of an ink tank and a recording head contained in the packet, wherein a protective member configured to protect one of an ink supply port of the ink tank and an ink discharge port of the recording head is mounted on one of the ink tank and on the recording head, and wherein an ammonia adsorption material is disposed in the protective member.

In another aspect of the present invention, a package includes a bag-like packet and at least one of an ink tank and a recording head contained in the packet, wherein an ammonia adsorption material is disposed in a component member of one of the ink tank and the recording head.

In another aspect of the present invention, a package includes a bag-like packet and at least one of an ink tank and a recording head contained in the packet, wherein an ammonia adsorption material is disposed in a component member of the packet.

More specifically, at present as a method for adsorbing ammonia gas, adsorption with zeolite and chemical deodorization method, and the like, are known. Zeolite is hydrated alumina-silicate salt mineral. This natural mineral ore has a rare characteristic and is notably much higher in amount of ions exchanged than other minerals. The surface area per 1 g is wide at 350 $m^2$. The superb ion exchange capacity and adsorption capacity as its representative properties, which can never be observed in other minerals, depend on its complicated chemical composition and crystal structure. At a macroscopic level, cations are fixed or quasi-fixed to carrier sites in the pores of zeolite, but cations can be released or adsorbed. In other words, the zeolite adsorbs various kinds of molecules in the cavities or in minute channels when they pass through the pores of the network structure. Those pores are normally about 0.1 to 7 Angstroms in diameter; therefore, the zeolite offers the so-called "molecular sieve" effect and exhibits a characteristic of adsorbing only molecules having a diameter smaller than that pore diameter. On account of the "molecular sieve" effect, it is possible to perform an adsorption-separation process according to the shape and size of molecules. Further, by dehydration or an acid or alkali process, the pore diameter can change, or zeolite cations, being normally at the sites which affect the molecular sieve action, can change the pore diameter. In other words, the mode of the "molecular sieve" action may differ with the kind and the quantity of ions in existence.

The present invention utilizes the adsorption-separation effect of zeolite described above. The adsorbed amount of ammonia gas issuing from the ink of an ink tank or a cartridge is controlled to such a degree as to prevent reaction with the electric contact, to thereby prohibit a limitless adsorption.

According to the present invention, by making use of the adsorption-separation characteristic of zeolite, it becomes possible to adsorb and release ammonia as one thinks proper. Therefore, it becomes possible to suppress major changes in the components of the ink held in the ink tank by repressing a reaction between ammonia gas and the wiring and the electric contact. Therefore, storage and distribution of ink tanks and cartridges become possible without incurring a deterioration of their printing characteristics.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Embodiment

Figure 1:
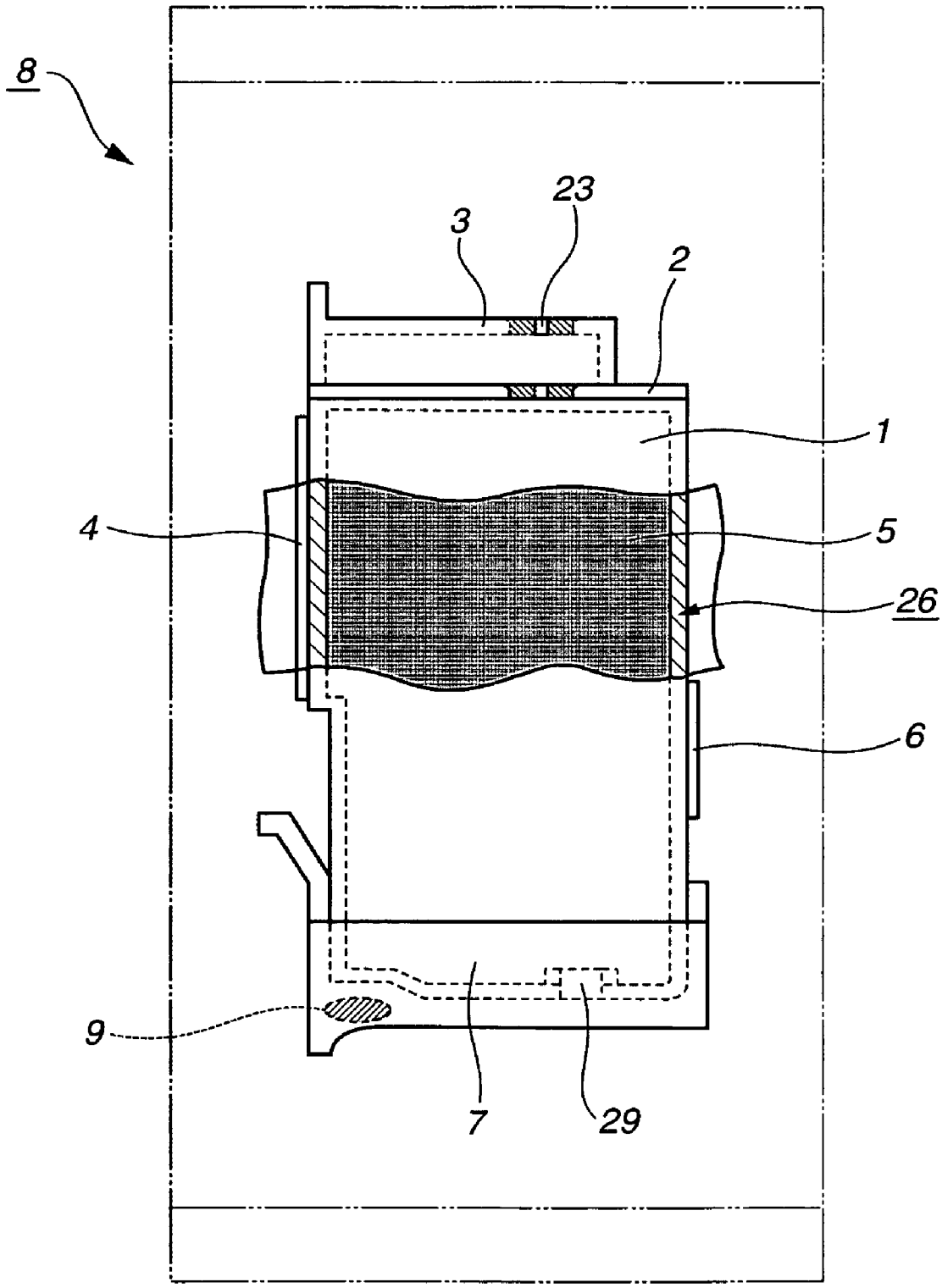
FIG. 1 is a diagram schematically showing a package including an ink tank and a bag for the ink tank according to a first embodiment of the present invention as they are seen through the bag.

FIG. 1 is a diagram schematically showing a package including an ink tank and a bag for the ink tank according to a first embodiment of the present invention as they are seen through the bag.

As shown in FIG. 1, a package is formed including a bag 8 for accommodating an ink tank 26 and a adsorption material 9. The ink tank 26 accommodates an ink absorber 5 such as a sponge in a container 1, the main component of the ink tank, and stores ink as the ink absorber 5 holds the ink. Under the condition that the ink tank 26 is put in use, an ink supply port 29 is located at the bottom of the container 1. When the ink tank 26 is mounted in the recording apparatus, the ink supply port is joined with the supply port of the recording head. A lid 2 is provided at the top of the container 1, and an ink reservoir is formed by the lid 2 and the container 1. A communicating port member 3 is provided at the top of the lid 2, and the container 1 can be communicated to the atmospheric air through an atmosphere communicating port formed in the communicating port member 3. A label 4, indicating a model number of the ink tank 26 and a color of ink stored, and so on, is affixed to a side wall of the container 1 of the ink tank 26. In addition, on a side wall of the ink tank 26, there is provided a substrate 6 of an electric circuit for storing information about the stored ink, such as a color of ink and a remaining amount, and so on. The ink tank structured as described is contained in the bag 8 and fitted with a cap 7 in a manner to tightly seal the ink supply port 29.

Figure 3A:
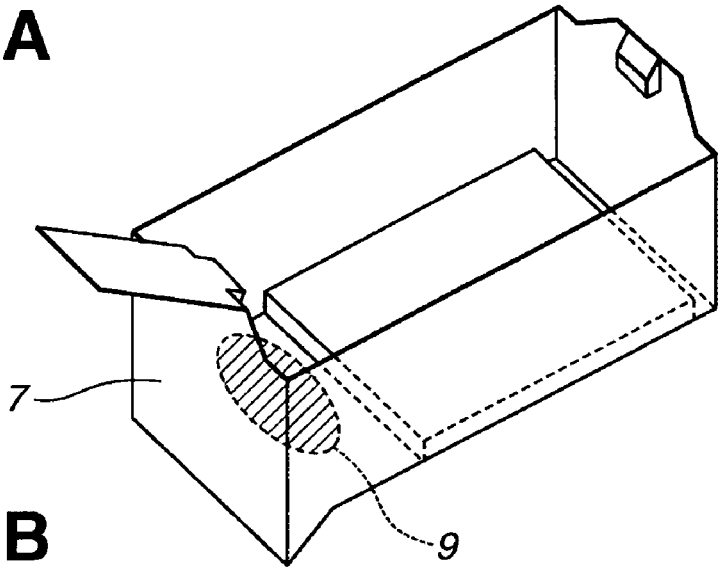
FIGS. 3A to 3D are diagrams in a perspective view and side views of the cap according to the first embodiment.
Figure 3B:
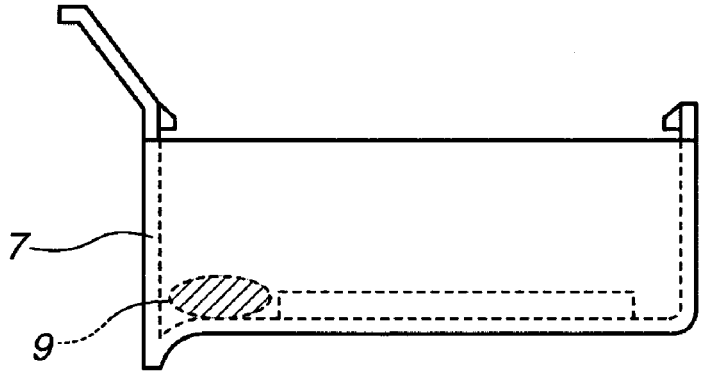

FIGS. 3A and 3B are diagrams in a perspective view and side views of the cap according to the first embodiment. As shown in FIGS. 3A and 3B, according to the first embodiment, referring to the cap 7 including the adsorption material 9 made of zeolite, the adsorption material 9 is arranged in a position in the cap 7 where the adsorption material does not interfere with the ink tank 26 when the cap 7 is attached to the ink tank 26. By this arrangement, it is possible to adsorb ammonia gas as an ink component that escapes especially from the ink tank 26 through the ink supply port 29 with respect to the ink supply port 29 and the atmosphere communicating port 23 of the ink tank 26, and thus hold down the amount of reaction of ammonia gas with the electrodes in the substrate 6 of the ink tank 26, for example. Moreover, since the zeolite of the adsorption material 9 adsorbs and separates ammonia gas and the adsorbed amount settles down to equilibrium, ammonia gas is not adsorbed limitlessly and it is possible to prevent a notable change in the components of the ink stored in the ink tank 26.

Note that for the adsorption material 9, it is possible to use an ammonia adsorption agent or some other substance that causes chemical decomposition of ammonia.

Second Embodiment

The second embodiment relates to another example of arrangement of the adsorption material.

Figure 2:
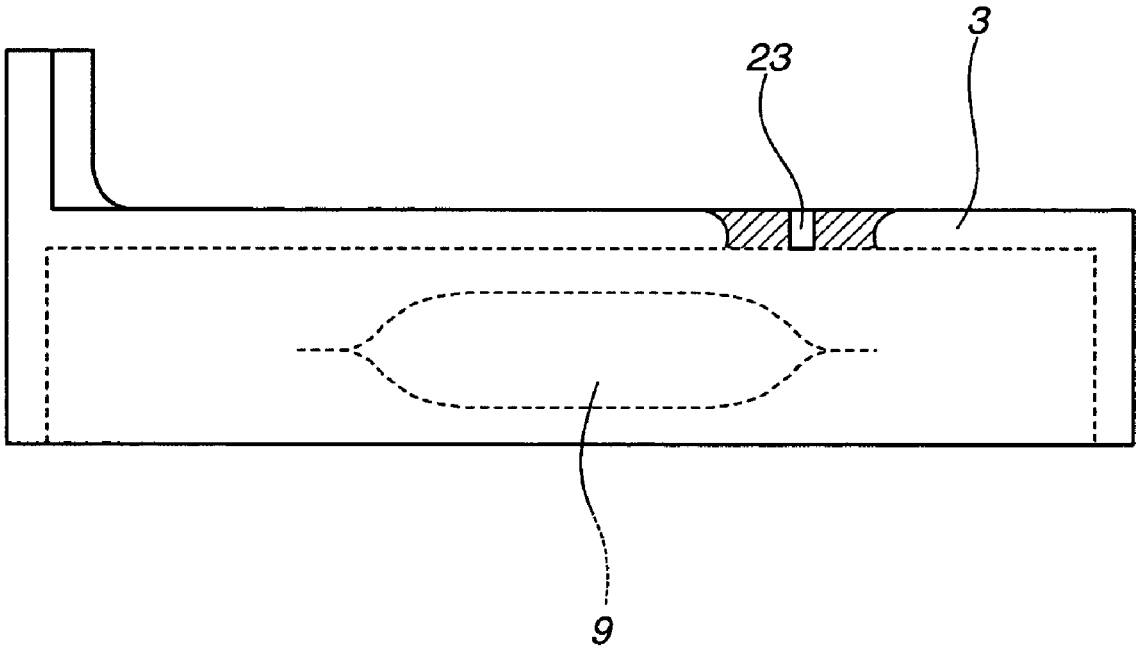
FIG. 2 is a schematic view showing a mode of zeolite as an adsorption material being mounted in an atmospheric air communicating member of the ink tank according to a second embodiment of the present invention.

FIG. 2 is a schematic view showing a mode of mounting zeolite as an adsorption material 9 inside an atmospheric air communicating member 3 of the ink tank 26. As shown in FIG. 2, zeolite as the adsorption material 9 is inserted into the communicating port member 3, and welded to the lid 2. Therefore, the same effects as described in the first embodiment can be obtained, for example, the adsorption material 9 can adsorb ammonia gas issuing from the inside of the ink tank 26, particularly through the atmosphere communicating port 23.

Third Embodiment

The third embodiment relates to yet another example of arrangement of the adsorption material.

Figure 4:
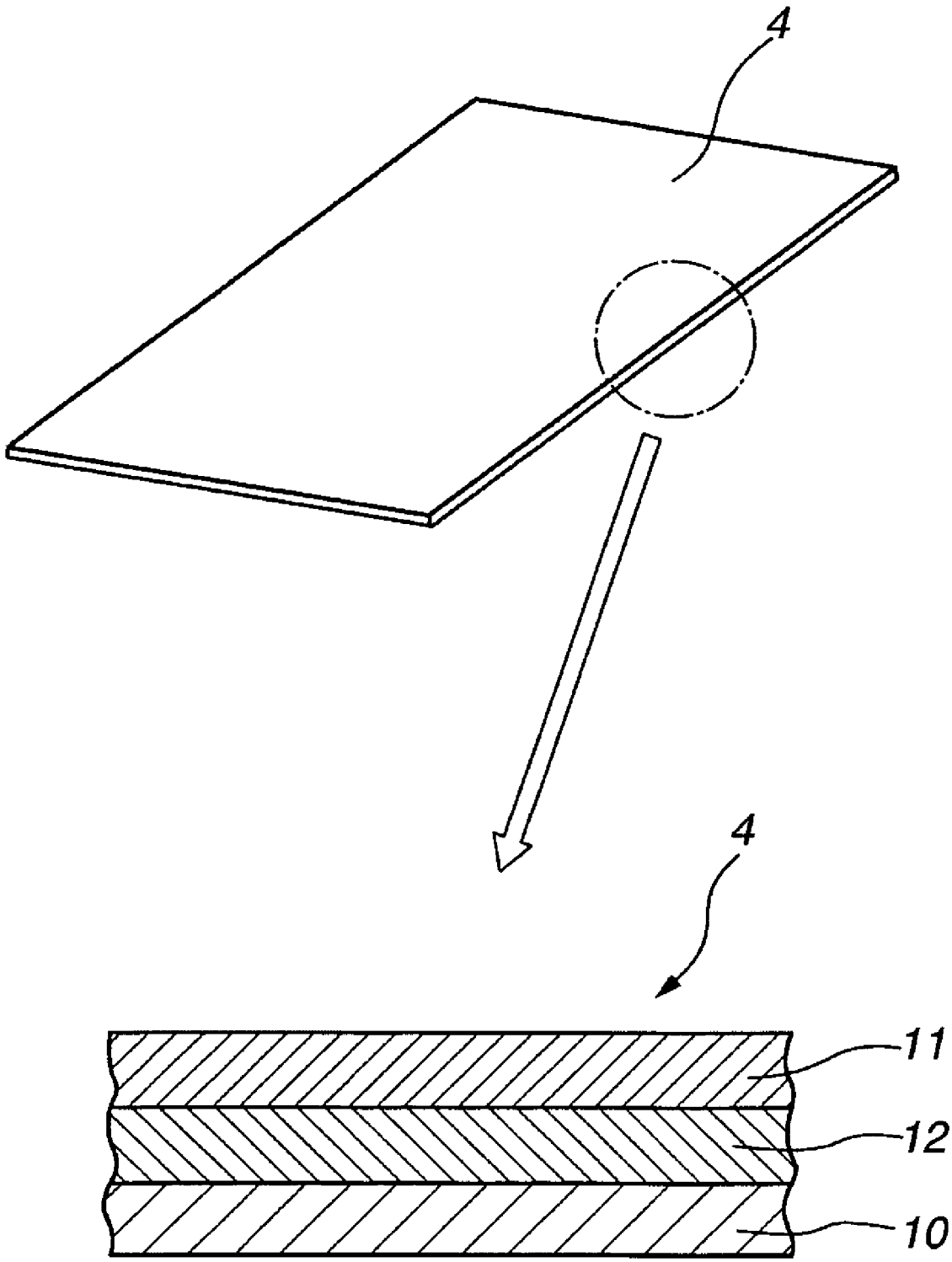
FIG. 4 is a diagram showing a mode of zeolite being mounted on a label attached to the ink tank according to a third embodiment of the present invention.

FIG. 4 is a diagram showing a mode of zeolite being mounted on a label attached to the ink tank 26. As shown in FIG. 4, the label 4 is formed with an adsorption layer 12 placed between the adhesive layer 10 and the label base material 11. The adsorption layer 12 is formed by incorporating zeolite powder therein. The same effects as described in the first embodiment can be obtained, for example, the ammonia gas existing in the bag 8 can be adsorbed. The user can handle the ink tank 26 and the bag 8 without being cognizant of zeolite being used as an adsorption agent. Therefore, the ink tank 26 and the bag 8 can be made in a simple structure by appearances.

Fourth Embodiment

The fourth embodiment relates to still another example of the arrangement of the adsorption material.

Figure 5A:
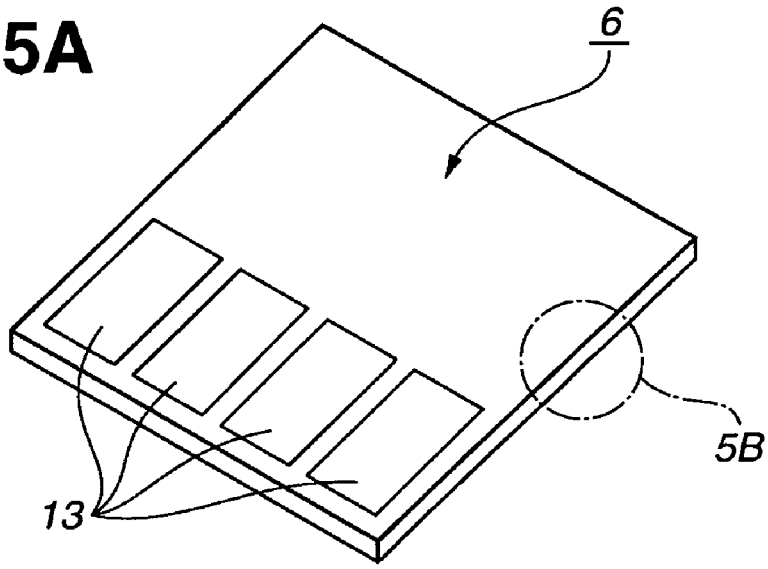
FIGS. 5A to 5C are diagrams for explaining that an adsorption layer of zeolite is mounted on a substrate attached to the ink tank according to a fourth embodiment of the present invention.
Figure 5B:
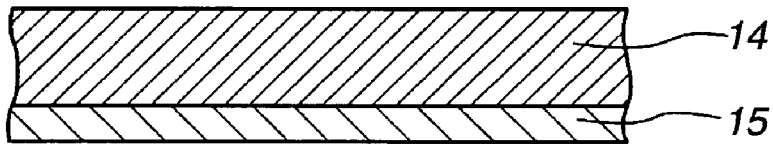

FIG. 5A shows details of the substrate 6 provided on the side wall of the ink tank 26. The substrate 6 is provided with contact pads 13. As shown in FIG. 5B, an adsorption layer 15 is coated on the underside of a base material 14, which forms the substrate, and the adsorption layer 15 is formed by incorporating zeolite powder therein. Therefore, the same effects as described in the third embodiment can be obtained, for example, the ammonia gas which exists in the bag 18 can be adsorbed.

Fifth Embodiment

The fifth embodiment relates to a further example of the arrangement of the adsorption material.

Figure 6A:
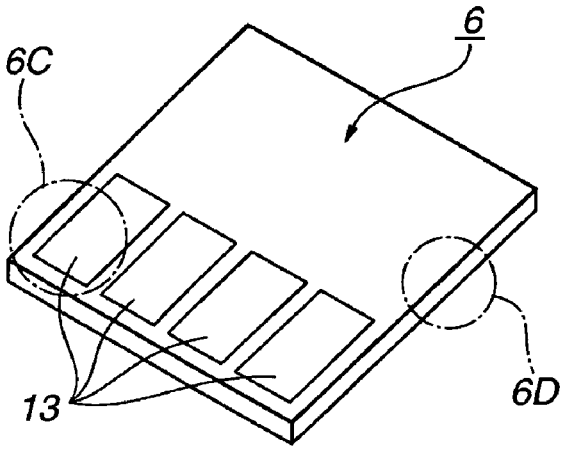
FIGS. 6A to 6D are diagrams for explaining that an adsorption layer of zeolite is mounted to a substrate attached to the ink tank according to a fifth embodiment of the present invention.
Figure 6C:
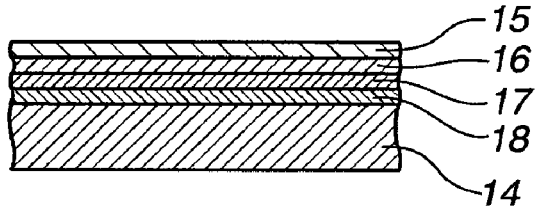

FIG. 6A is a diagram showing details of the substrate 6 mounted on the side wall of the ink tank 26. As shown in FIG. 6D, an adsorption layer 15 and so on are deposited by coating on the surface of the substrate 6 and the adsorption layer 15 is formed by incorporating zeolite powder therein. Therefore, the same effects as described in the third embodiment can be obtained; more specifically, ammonia gas present in the bag 8 can be adsorbed.

Sixth Embodiment

The sixth embodiment relates to an additional example of the arrangement of the adsorption material.

Figure 7A:
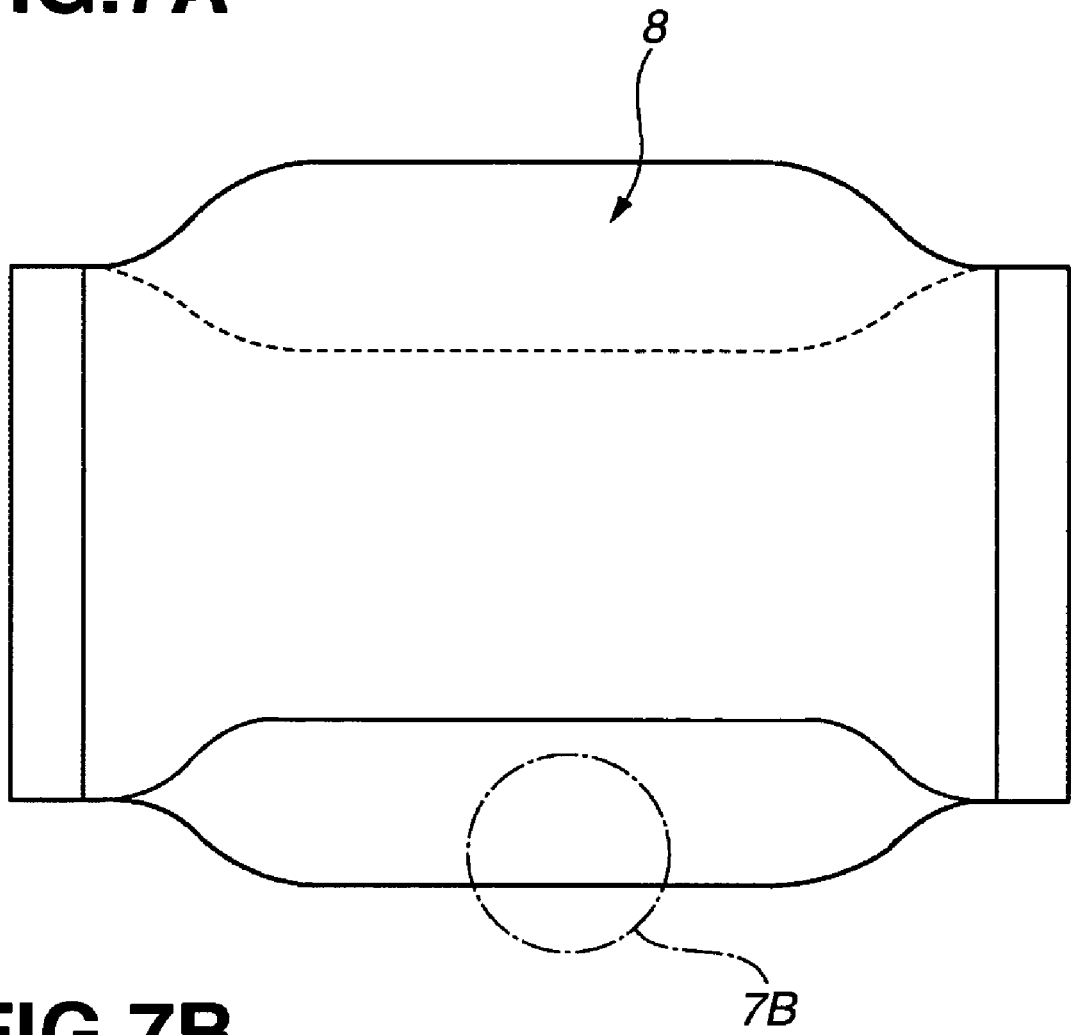
FIGS. 7A to 7B are diagrams for explaining that an adsorption layer is provided on the inside of a CCP layer and an OPP layer that constitute the sheet of the bag, and this adsorption layer is formed by coating of zeolite in powder form.
Figure 7B:
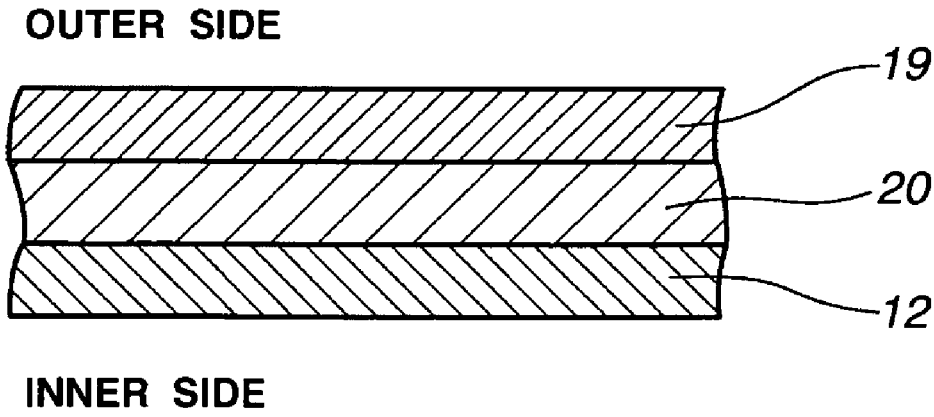

FIGS. 7A to 7B are diagrams for explaining that an adsorption layer 12 is deposited inside a CCP layer 19 and an OPP layer 20 that constitute the sheet of the bag 8 and finished by coating of zeolite in powder form. Accordingly, it is possible to obtain the same effects as described in the third embodiment, for example, ammonia gas existing in the bag 8 can be adsorbed.

Seventh Embodiment

Figure 8:
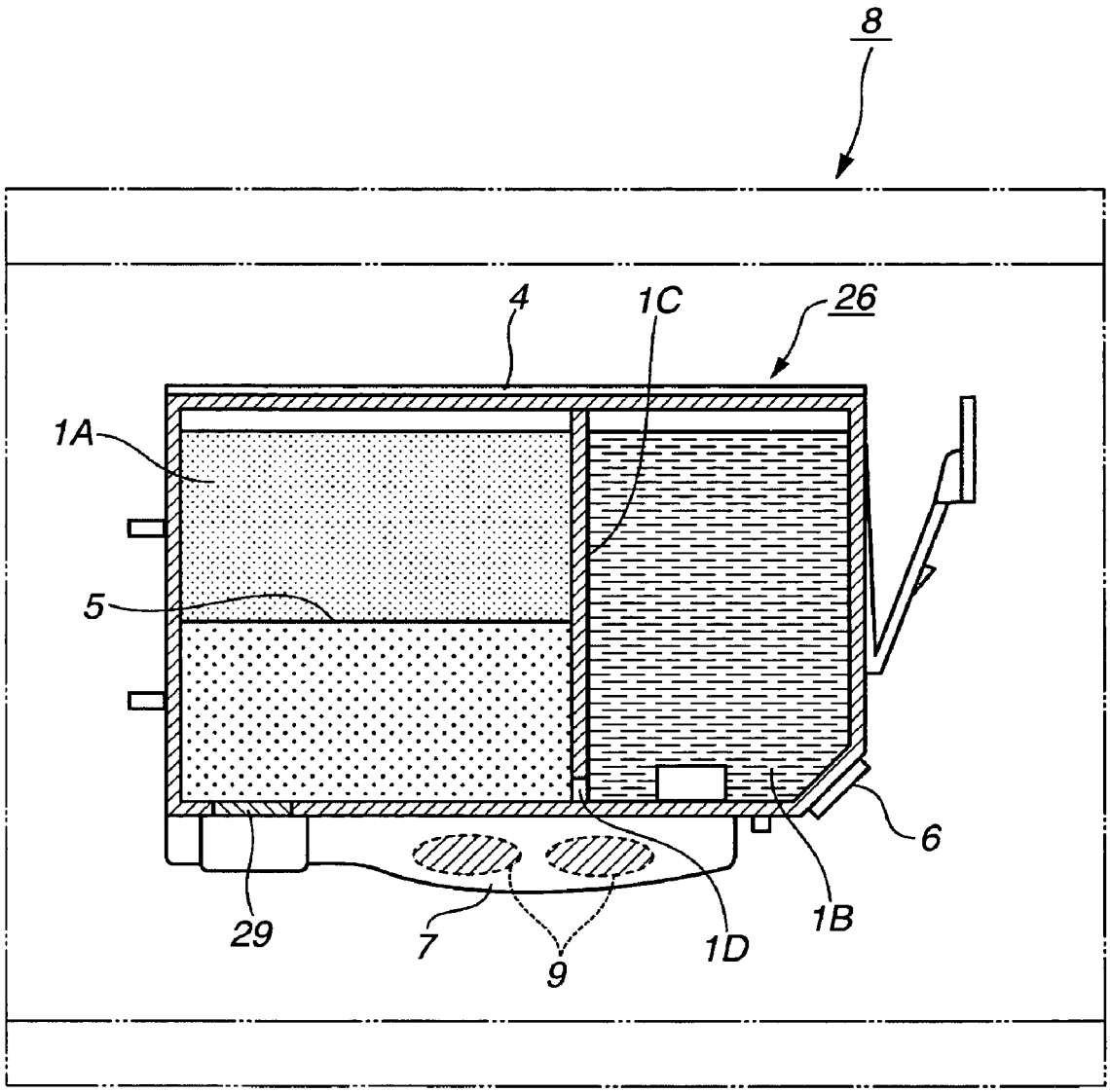
FIG. 8 is a diagram schematically showing a package including an ink tank and a bag for the ink tank according to a seventh embodiment of the present invention as they are seen through the bag.

FIG. 8 is a diagram schematically showing a package including an ink tank and a bag for the ink tank according to a seventh embodiment of the present invention as they are seen through the bag.

As shown in FIG. 8, the package according to the seventh embodiment is formed including a bag 8 for accommodating an ink tank 26 and an adsorption material 9. The ink tank 26 of this embodiment differs in structure from the structural example in FIG. 1. More specifically, in the ink tank according to the seventh embodiment, the container 1 is divided into an absorber chamber 1A and an ink chamber 1B. Those two chambers are separated by a partition wall 1C. At the bottom portion of the partition wall 1C (on the right side of FIG. 8), there is provided a passageway 1D for communication between the two chambers. Through the passageway, the atmosphere and the liquid are exchanged between the two chambers. The ink tank 26 is fitted with a cap 7, and the ink supply port 29 of the ink tank 26 is tightly sealed with this cap. At one corner of a substantially cuboid ink tank 26, an inclined surface is formed which looks like chamfered. A substrate 6 is mounted on the inclined surface.

Figure 3C:
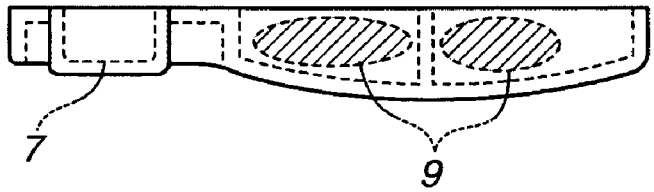
Figure 3D:
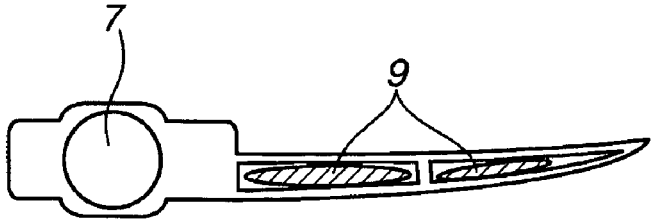

FIGS. 3C to 3D are a front view and a side view showing the cap 7 described above. Referring to the cap 7 with the adsorption material 9 of zeolite according to the seventh embodiment, the adsorption material 9 is arranged in a position in the cap 7 where the adsorption material does not interfere with the ink tank 26 when the cap 7 is mounted to the ink tank 26. By this arrangement, the same effects as described in the first embodiment of the present invention can be obtained.

Eighth Embodiment

The eighth embodiment relates to yet still another example of the adsorption embodiment.

As shown in the fourth embodiment of FIGS. 5A and 5B, the adsorption layer 15 is coated on the backside of a base material 14 which forms the substrate 6 attached to the corner of the ink tank 26. The adsorption layer 15 is formed by incorporating zeolite powder therein. Therefore, the same effects as described referring to the fourth embodiment can be obtained, for example, the ammonia gas existing in the bag 8 can be adsorbed.

Ninth Embodiment

The ninth embodiment relates to yet still another example of arrangement of the adsorption material.

As shown in the fifth embodiment of FIGS. 6A and 6D, according to the ninth embodiment, an adsorption layer 15 is coated on the surface of the substrate 6 provided at one corner of the ink tank 26, and this adsorption layer 15 is formed by incorporating zeolite powder therein. As shown in FIG. 6C, an adsorption layer 15 is coated on the surfaces of the contact pads 13 with the pore-sealing material of incorporated zeolite. Thus, the same effects as described in the fifth embodiment can be obtained, for example, ammonia gas existing in the bag 8 can be adsorbed.

Tenth Embodiment

The tenth embodiment relates to yet another example of arrangement of the tenth embodiment.

As shown in the sixth embodiment of FIGS. 7A and 7B, according to the tenth embodiment, an adsorption layer 12 is coated on the inside of a CCP layer 19 and an OPP layer 20, which constitute the sheet of the bag 8, and this adsorption layer 12 is formed by coating zeolite powder. Accordingly, the same effects as described in the sixth embodiment can be obtained, for example, ammonia gas existing in the bag 8 can be adsorbed.

Eleventh Embodiment

Figure 9:
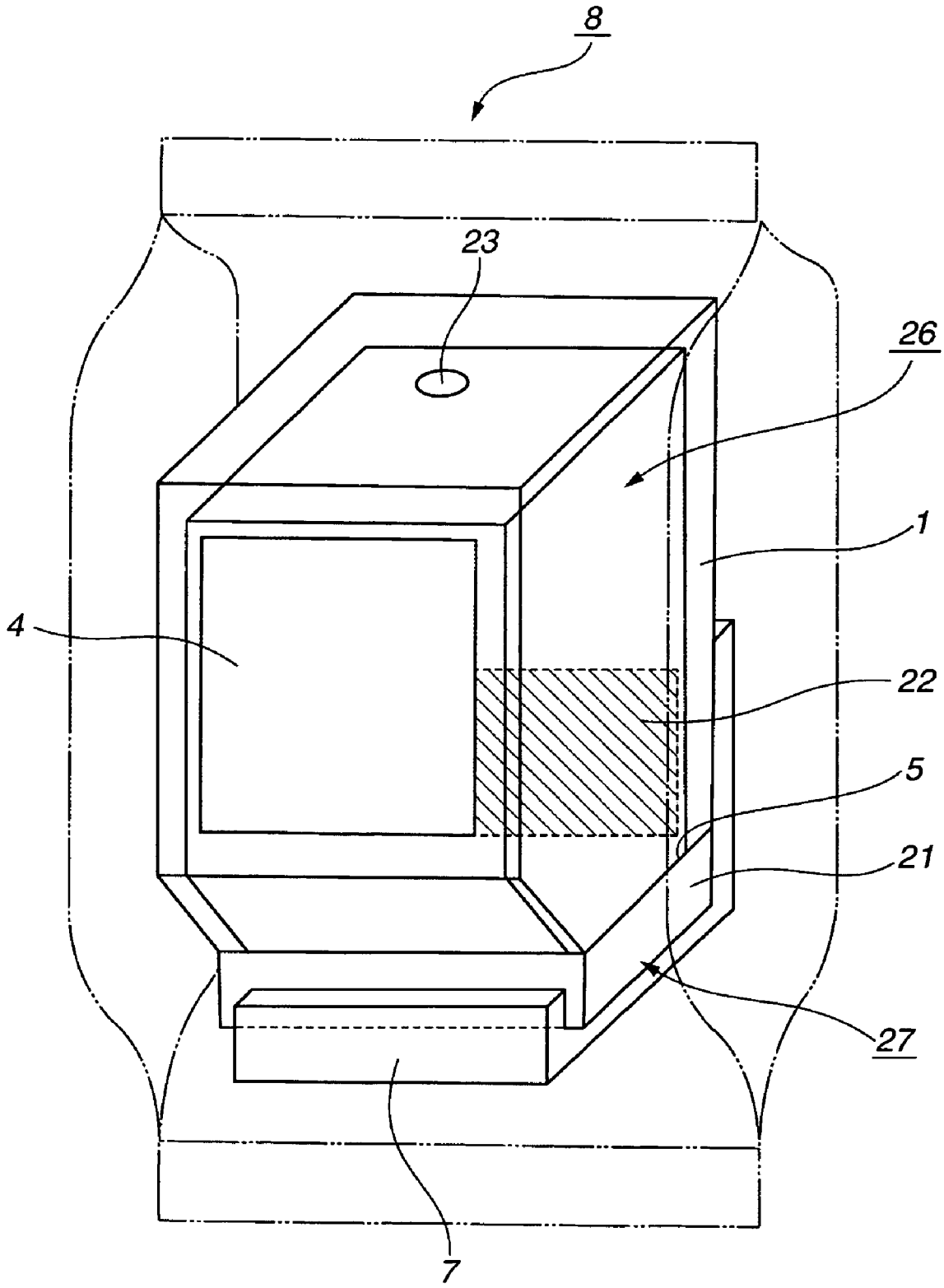
FIG. 9 is a perspective diagram showing a package including an ink tank and a bag for the ink tank according to an eleventh embodiment of the present invention as they are seen through the bag.

FIG. 9 is a diagram perspectively showing a package including a unified body of an ink tank 26 and a recording head 27, and a bag for accommodating the unified body as they are seen through the bag according to an eleventh embodiment of the present invention.

As shown in FIG. 9, the package according to the eleventh embodiment is formed including a unified body of the ink tanks 26 and the recording head in the bag 8. In other words, the ink tank 26 according to the eleventh embodiment is formed integrally with the recording head 27, and an electric contact 22 is mounted on the rear side of the ink tank 26. Under this arrangement, when an integral type cartridge is mounted on a carriage of a main apparatus, the electric contact 22 is connected to the contact of the main apparatus and it becomes possible to transmit or receive electric signals with the main apparatus. The cap 7 is put on the discharge part 21 of the recording head 27, so that the ink discharge port of the recording head 27 is closed tightly.

According to the eleventh embodiment, like in the embodiment shown in FIG. 3A, the adsorption material 9 is arranged in a position in the cap 7 where the adsorption material 9 does not interfere with the recording head 27 when the cap 7 is attached to the recording head 27. Under this arrangement, the same effects as described in the first embodiment can be obtained in this embodiment. In other words, even if ammonia gas as an ink component of the ink stored in the ink tank 26 emerges from the discharge port of the recording head 27 or the like and stays in the bag 8, the ammonia gas can be adsorbed by the adsorption material 9 made of zeolite. Thus, it is possible to reduce the effects of ammonia gas on the electrodes of the electric contact 22 and the like.

Twelfth Embodiment

The twelfth embodiment relates to another example of arrangement of an adsorption material used in a package accommodating a unified cartridge of ink tanks and a recording head, and a bag for the cartridge shown in FIG. 9.

Figure 5C:
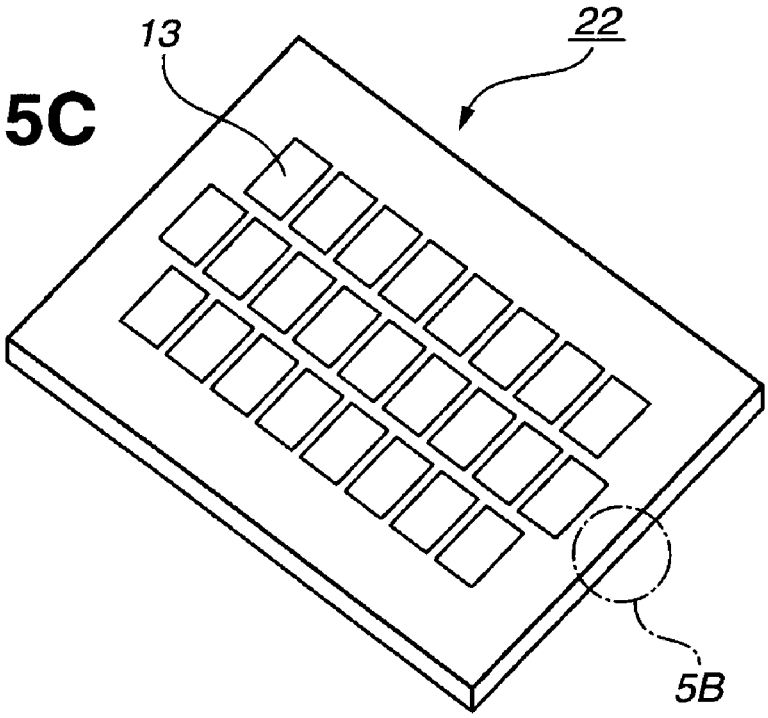

As described above in the fourth embodiment of FIGS. 5B and 5C, an adsorption layer 15 is coated on the underside of the base material 14 that forms the substrate for the electric contact 22 to be mounted on the ink tank 26, and the adsorption layer 15 is formed by incorporating zeolite powder therein. The same effects as described in the fourth embodiment can be obtained, for example, ammonia gas existing in the bag 8 can be adsorbed.

Thirteenth Embodiment

The thirteenth embodiment relates to an additional example of arrangement of the adsorption material in a package including an integral type cartridge and a bag for the cartridge as shown in FIG. 9.

Figure 6B:
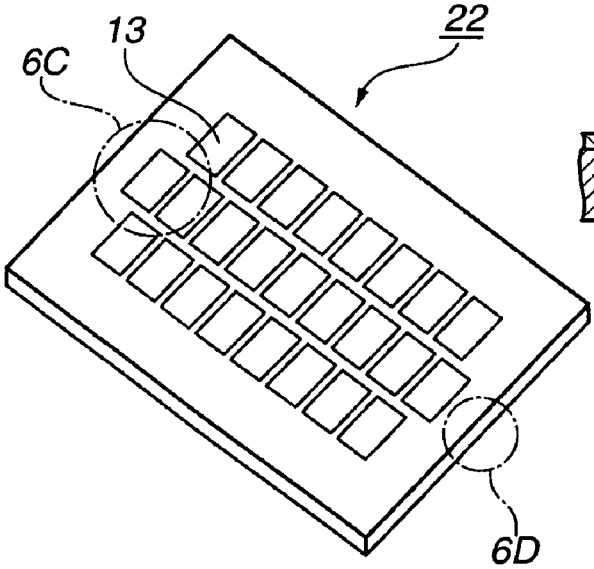
Figure 6D:
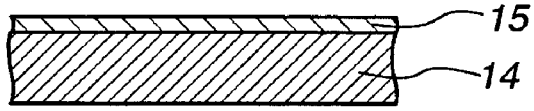

As shown in the fifth embodiment of FIGS. 6B and 6D, according to the thirteenth embodiment, an adsorption layer 15 is coated on the surface of the substrate of the electric contact 22 provided on the back surface of the ink tank 26, and the adsorption layer 15 is formed by incorporating powdered zeolite therein. Moreover, as shown in FIG. 6C, similarly, an adsorption layer 15 is coated on the surfaces of the contact pads 13, and the adsorption layer 15 is formed by incorporating zeolite therein. A zeolite-incorporated pore-sealing material is used in the coating. Therefore, the same effects as described in the fifth embodiment can be obtained in this embodiment, for example, ammonia gas existing in the bag 8 can be adsorbed.

Fourteenth Embodiment

The fourteenth embodiment relates to another example of arrangement of the adsorption material in a package including an integral type cartridge and a bag for the cartridge as shown in FIG. 9.

As shown in the sixth embodiment of FIGS. 7A and 7B, according to the fourteenth embodiment, an adsorption layer 12 is coated on the inside of the CCP layer 19 and the OPP layer 20 that constitute the sheet of the bag 8. The adsorption layer 12 is formed by incorporating powdered zeolite therein. Consequently, the same effects as described in the sixth embodiment can be obtained, for example, ammonia gas present in the bag 8 can be adsorbed.

Fifteenth Embodiment

Figure 10:
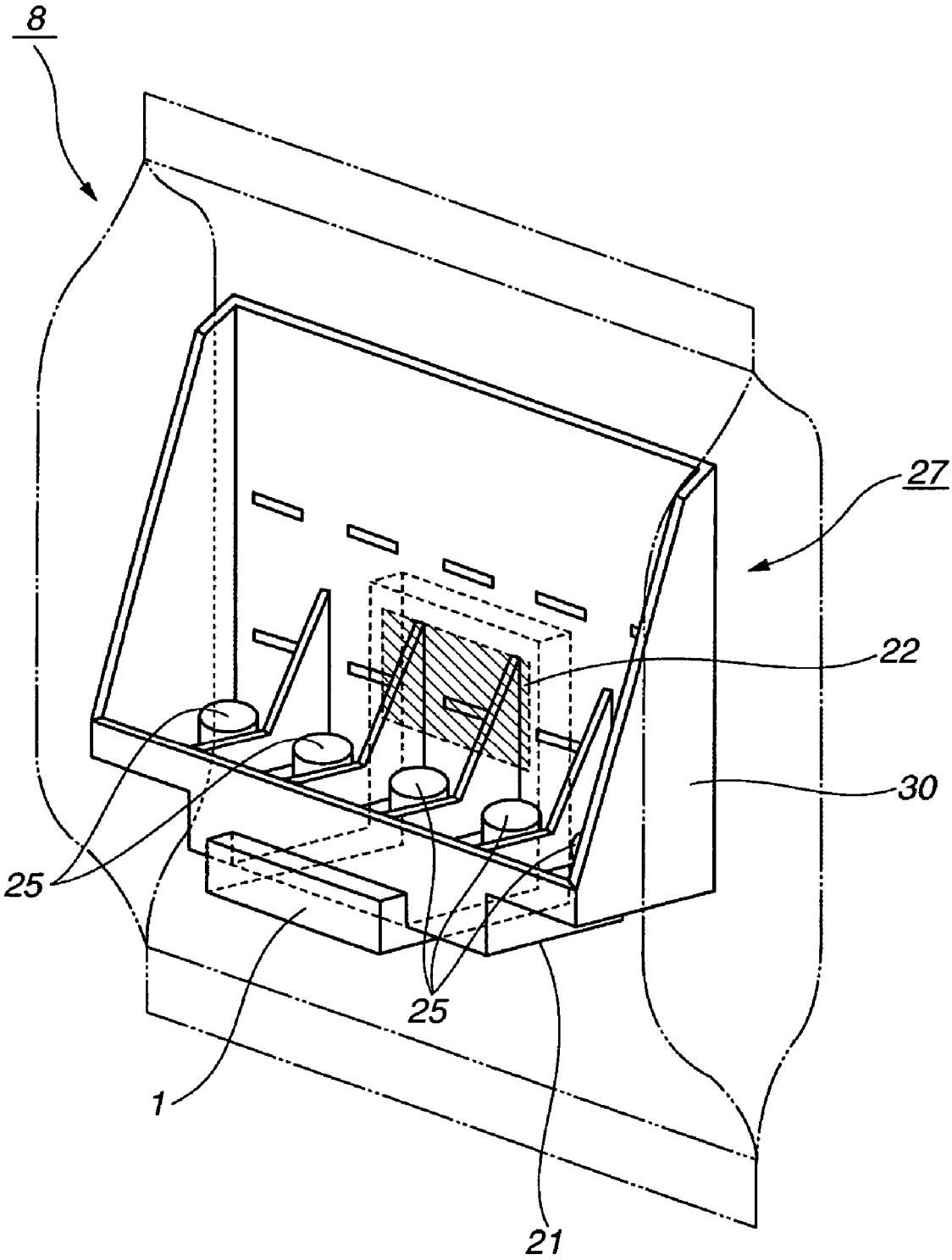
FIG. 10 is a perspective diagram showing a package including an ink tank and a bag for the ink tank according to a fifteenth embodiment of the present invention as they are seen through the bag.

FIG. 10 is a diagram perspectively showing a package including a recording head and a bag for the recording head as they are seen through the bag according to the fifteenth embodiment of the present invention.

As shown in FIG. 10, the package according to the fifteenth embodiment is formed including the recording head 27 in the bag. More specifically, the recording head 27 according to the fifteenth embodiment is detachable from the carriage of recording apparatus, and the recording head 27 is packaged in a bag in the course of distribution process.

As shown in FIG. 10, the recording head 27 according to the fifteenth embodiment, is roughly configured of a holder 30 with a harness for installing the ink tank, and a discharge part 21. The substrate for the electric contact 22 is mounted to the rear side of the holder 30. In the harness corresponding to ink tanks of each color, there are provided ports 25 to receive ink from the supply ports 29 of respective ink tanks when the receiving ports 25 are connected to the supply ports 29. To preserve the quality of the recording head 27, ink for distribution purposes, which excludes the color components of the ink, is injected to the recording head 27. Under the condition that the recording head is put in a bag 8, a cap 7 is attached to the discharge part 21 of the recording head 27, so that the ink discharge port of the recording head 27 is placed in a tightly-sealed state.

As shown in the embodiment of FIG. 3A, according to the fifteenth embodiment, the adsorption material 9 of zeolite is arranged in a position in the cap 7 where the adsorption material 9 does not interfere with the recording head 27 when the cap 7 is mounted on the recording head 27. In the fifteenth embodiment, the above-mentioned ammonia gas may occasionally emerge from the distribution-purpose ink in the course of distribution process. In such a case, the generated ammonia gas can be adsorbed by the adsorption material 9 disposed in the cap 7, thus reducing the effects of ammonia gas on the electric contact 22.

Sixteenth Embodiment

The sixteenth embodiment relates to yet another example of arrangement of the adsorption material in a package including a recording head and a bag for the recording head shown in FIG. 10.

As described above in the fourth embodiment of FIGS. 5B and 5C, an adsorption layer 15 is coated on the underside of the base material 14 that forms the substrate for the electric contact 22 provided on the rear side of the holder 30 of the recording head 27. The adsorption layer 15 is formed by incorporating powdered zeolite therein. Consequently, the same effects as having been described in the fourth embodiment can be obtained, namely, ammonia gas existing in the bag 8 can be adsorbed.

Seventeenth Embodiment

The seventeenth embodiment relates to another example of arrangement of the adsorption material in a package including a recording head and a bag for the recording head as shown in FIG. 10.

As shown in the fifth embodiment of FIGS. 6B and 6D, according to the seventeenth embodiment, the adsorption layer 15 is coated on the surface of the substrate for the electric contact 22 mounted on the rear side of the holder 30 of the recording head 27. The adsorption layer 15 is formed by incorporating powdered zeolite therein. Similarly, an adsorption layer 15 is coated on the surfaces of the contact pads 13 as shown in FIG. 6C. The coated adsorption layer 15 is formed by incorporating zeolite therein. A zeolite-incorporated pore-sealing material is used for the coating. Therefore, the same effects as described in the fifth embodiment can be obtained, for example, ammonia gas existing in the bag 8 can be adsorbed.

Eighteenth Embodiment

The eighteenth embodiment relates to a further example of arrangement of the adsorption material in a package including a recording head and a bag for the recording head as shown in FIG. 10.

As shown in the sixth embodiment of FIGS. 7A and 7B, according to the eighteenth embodiment, an adsorption layer 12 is provided on the inside of a CCP layer 19 and an OPP layer 20 that constitute the sheet of the bag 8 and this adsorption layer 12 is formed by coating zeolite powder. Accordingly, it is possible to obtain the same effects as described in the sixth embodiment, for example, ammonia gas existing in the bag 8 can be adsorbed.

OTHER EMBODIMENTS

Figure 11:
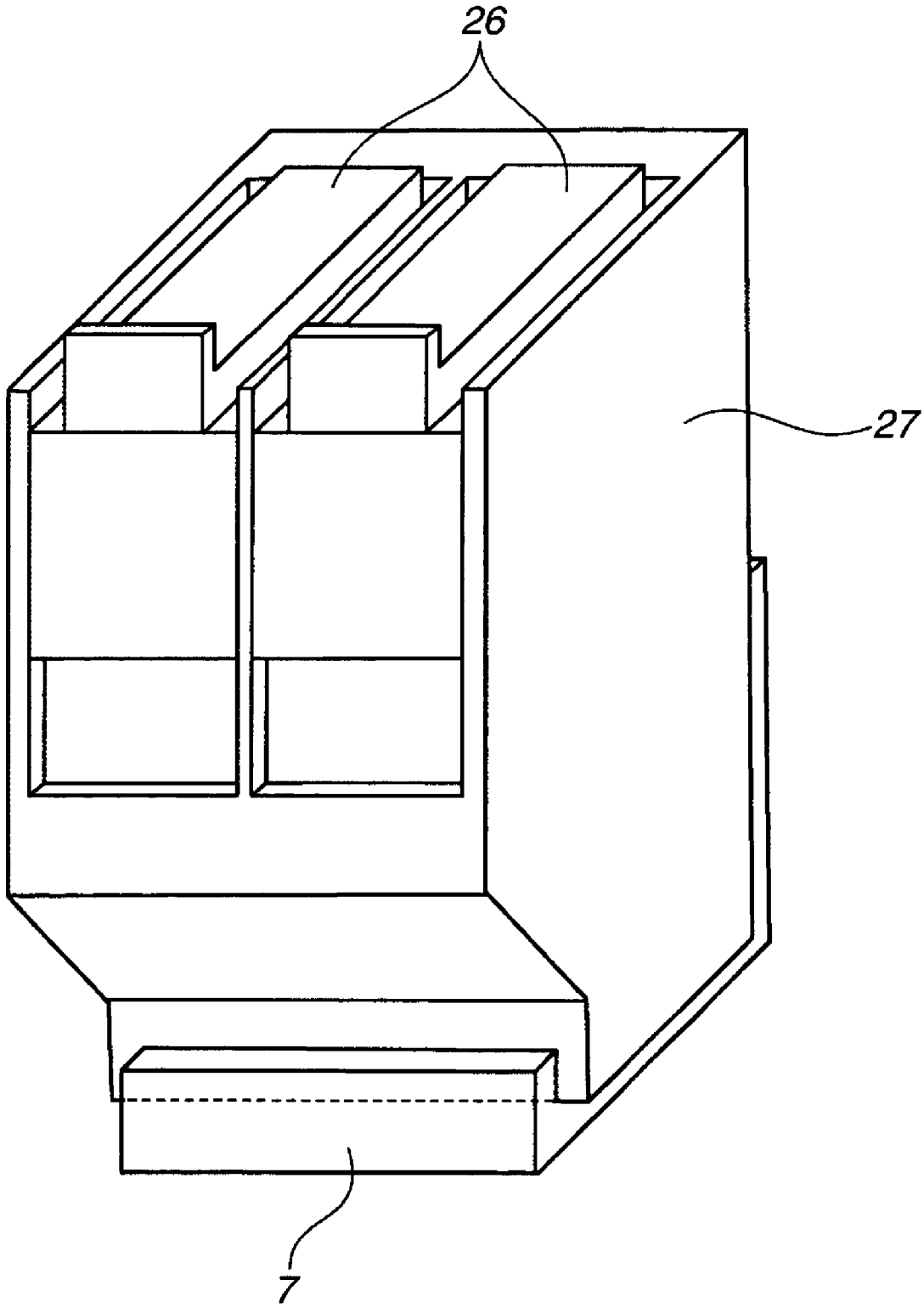
FIG. 11 is a perspective diagram showing a mounted state of the ink tank and the recording head according to the embodiments of the present invention.
Figure 12:
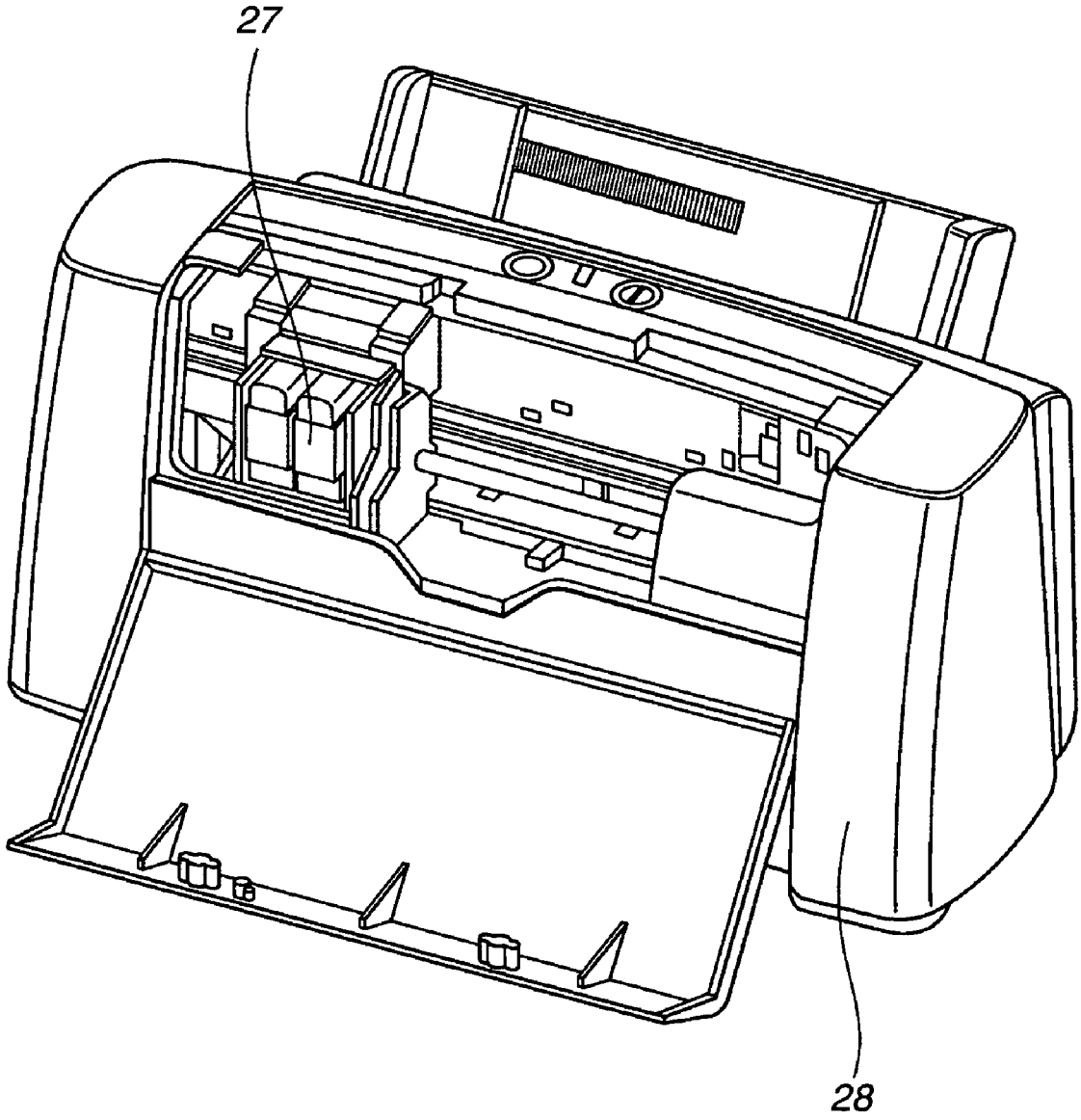
FIG. 12 is a perspective diagram showing a state that the recording head and the ink tank shown in FIG. 11 are mounted in the carriage of a printer.

In the above-described embodiments of the present invention, FIG. 11 shows a configuration in which, instead of using an integral type cartridge, the ink tanks 26 and the recording head 27 are used and mounted in an interrelated manner, and FIG. 12 shows a configuration in which the recording head 27 and the ink tanks 26 are mounted in the carriage of a printer.

In the above-described embodiments, in a type of package which includes a cartridge or a recording head in a bag, the adsorption material may be located at the label attached to the recording head or near the atmosphere communicating port.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-357306 filed Dec. 9, 2004, which is hereby incorporated by reference herein in its entirety.

What is claimed is:

1. An ink tank comprising:

a container adapted to contain an ink absorber which absorbs ink;

a lid adapted to close the container;

a supply port adapted to supply ink absorbed by the ink absorber to outside;

a substrate including a contact facilitating electric connection;

a communicating port member provided at the lid, wherein the container is communicated to the atmospheric air through a communicating port formed in the communicating port member; and an ammonia adsorbing material disposed within the communicating port member, wherein the lid prevents the ammonia adsorbing material from coming in contact with the ink absorber.

2. The ink tank according to claim 1, wherein the ammonia adsorbing material is composed of zeolite.

3. An ink tank comprising:

a container adapted to contain ink;

a supply port adapted to supply ink to outside;

a substrate disposed on an outer surface of the container, the substrate having a first surface and a second surface opposite to the first surface;

a contact disposed on the first surface and configured to facilitate electric connection; and an ammonia adsorbing layer coated on the second surface, wherein the outer surface of the container where the substrate is disposed is different from the surface where the supply port is disposed.

4. An ink tank comprising:

a container adapted to contain ink;

a supply port adapted to supply ink to outside; and a label member adhered on an outer surface of the container, the label member being formed with a label base layer, an adhesive layer, and an ammonia adsorbing layer placed between the label base layer and the adhesive layer, wherein the outer surface of the container where the label member is adhered is different from the surface where the supply port is disposed.

5. A recording head for discharging ink, the recording head comprising:

a discharge port adapted to discharge ink;

a substrate disposed on an outer surface of the recording head having a first surface and a second surface opposite to the first surface;

a contact disposed on the first surface configured to facilitate an electric connection; and an ammonia adsorbing layer coated on the second surface;

wherein the outer surface of the recording head where the substrate is disposed is different from the surface where the discharge port is disposed.

6. A packaged ink tank comprising:

a packaging member adapted to package the packaged ink tank in an airtight condition;

a container adapted to contain an ink absorber which absorbs ink;

a lid adapted to close the container;

a supply port adapted to supply ink absorbed by the ink absorber to the outside;

a substrate including a contact facilitating an electric connection;

a communicating port member provided at the lid, wherein the container is communicated to the atmospheric air through an communicating port formed in the communicating port member; and an ammonia adsorbing material disposed within the communicating port member, wherein the lid prevents the ammonia adsorbing material from coming in contact with the ink absorber.

7. A packaged ink tank comprising:

a packaging member adapted to package the packaged ink tank in an airtight condition;

a container adapted to contain ink;

a supply port adapted to supply ink to outside;

a substrate disposed on outer surface of the container, the substrate has a first surface and a second surface opposite to the first surface;

a contact disposed on the first surface configured to facilitate an electric connection; and an ammonia adsorbing layer coated on the second surface;

wherein the outer surface of the container where the substrate is disposed is different from the surface where the supply port is disposed.

8. A packaged ink tank comprising:

a packaging member adapted to package the packaged ink tank in an airtight condition;

a container adapted to contain ink;

a supply port adapted to supply ink to outside; and a label member adhered on an outer surface of the container, the label member is formed with a label base layer, an adhesive layer, and an ammonia adsorbing layer placed between the label base layer and the adhesive layer; and wherein the outer surface of the container where the label member is adhered is different from the surface where the supply port is disposed.

9. A packaged recording head comprising:

a packaging member adapted to package the packaged recording head in an airtight condition;

a discharge port adapted to discharge ink;

a substrate disposed on an outer surface of the recording head, the substrate has a first surface and a second surface opposite to the first surface; and a contact disposed on the first surface and configured to facilitate an electric connection; and an ammonia adsorbing layer coated on the second surface, wherein the outer surface of the container where the substrate is disposed is different from the surface where the discharge port is disposed.

* * * * *